US009976796B2

(12) United States Patent
Jang

(10) Patent No.: US 9,976,796 B2
(45) Date of Patent: May 22, 2018

(54) REFRIGERATOR

(71) Applicant: Dongbu Daewoo Electronics Corporation, Seoul (KR)

(72) Inventor: Won Woo Jang, Seoul (KR)

(73) Assignee: Dongbu Daewoo Electronics Corporation, Seoul (KR)

( * ) Notice: Subject to any disclaimer, the term of this patent is extended or adjusted under 35 U.S.C. 154(b) by 0 days. days.

(21) Appl. No.: 15/481,216

(22) Filed: Apr. 6, 2017

(65) Prior Publication Data

US 2017/0292774 A1 Oct. 12, 2017

(30) Foreign Application Priority Data

Apr. 12, 2016 (KR) ..... 10-2016-0045062

(51) Int. Cl.
*F25D 23/02* (2006.01)
*F25D 11/00* (2006.01)

(52) U.S. Cl.
CPC ..... *F25D 23/028* (2013.01); *F25D 11/00* (2013.01); *Y10T 16/458* (2015.01)

(58) Field of Classification Search
CPC ..... Y10T 16/458; F25D 23/028; F25D 23/02; F25D 11/00; E05Y 2900/31; E05B 1/003; A47B 95/02
USPC ..... 16/412; 312/405; 62/440; 292/336.3
See application file for complete search history.

(56) References Cited

U.S. PATENT DOCUMENTS 2,809,402 A * 10/1957 Southworth ..... F25D 23/02 219/213
3,403,473 A * 10/1968 Navarro ..... E05D 15/502 16/230
6,354,119 B1 * 3/2002 Molzer ..... E05B 13/106 292/336.3

FOREIGN PATENT DOCUMENTS

KR 20-0194167 Y1 9/2000
KR 10-2009-0131427 A 12/2009
KR 10-1483993 B1 1/2015

* cited by examiner

*Primary Examiner* — William Miller

(57) ABSTRACT

A refrigerator including a rotatable door handle. The door handle is rotatably coupled to a refrigerator door through a through-hole on the door. The door handle includes a grip portion, a connection portion fastened to the grip portion, and an insertion portion protruding from the connection portion. The insertion portion includes an engaging projection protruding outward from a peripheral surface of the insertion portion. The door handle includes two stoppers. During the process of assembling the door handle with the door, the engaging projection may be rotated in the first direction until it engage with a first stopper to. In an assembled state, the door is opened or closed when the door handle is rotated in the second direction. The second stopper can stop rotation of the door handle in the second direction when the engaging projection engages with the second stopper.

11 Claims, 7 Drawing Sheets

REFRIGERATOR

CROSS-REFERENCE TO RELATED APPLICATIONS

This application is based on and claims priority from Korean Patent Application No. 10-2016-0045062, filed on Apr. 12, 2016, the disclosure of which is incorporated herein in its entirety by reference for all purposes.

TECHNICAL FIELD

Embodiments of the present disclosure relate to refrigerators, and more particularly, to door opening mechanisms in refrigerators.

BACKGROUND

A refrigerator is an appliance used for storing food at a low temperature and may be configured to store food (or other items)in a frozen state or a refrigerated state. The inside of the refrigerator is cooled by circulating cold air that can be continuously generated through a heat exchange process by using a refrigerant.

A door handle is usually mounted on a door of the refrigerator to facilitate opening and closing of the door by users. The door handle may be fastened to the door by a screw or the like. The door handle may be shaped in a bar or rod shape to easily grip.

Conventionally, a door handle is fixed to a door and is not moveable in relation to the door. This poses a problem that a user may strain his or her wrist when opening the door using the fixed door handle.

PRIOR ART DOCUMENTS

Patent Documents

Patent Document 1: Korean Patent Registration Publication No. 10-1483993 (registered on Jan. 13, 2015)

SUMMARY

Embodiments of the present disclosure provide a refrigerator including a door handle that allows a user to open a door with reduce effort.

The present disclosure provides a refrigerator, comprising: a door having a through-hole; a door handle rotatably coupled to the door; an intermediary member installed on a front surface of the door and coupled to the door handle; and a front protrusion portion inserted into the through-hole and protruding from a front surface of the intermediary member toward a front side of the door, wherein the door handle includes a grip portion to gripped by a user, a connection portion fastened to the grip portion and provided with an undercut portion capable of accommodating the front protrusion portion, and an insertion portion protruding from the connection portion, the insertion portion including an engaging projection protruding outward from a peripheral surface of the insertion portion.

A rear protrusion portion may be formed at a radial outer side of the insertion portion and protruding from a rear surface of the intermediary member toward a rear side of the door.

The door handle may include two stoppers. During the process of assembling the door handle with the door, the engaging projection may be rotated in the first direction until it engage with a first stopper. In an assembled state, the door is opened or closed when the door handle is rotated in the second direction. The second stopper can stop rotation of the door handle in the second direction when the engaging projection engages with the second stopper.

DETAILED DESCRIPTION

Figure 1:
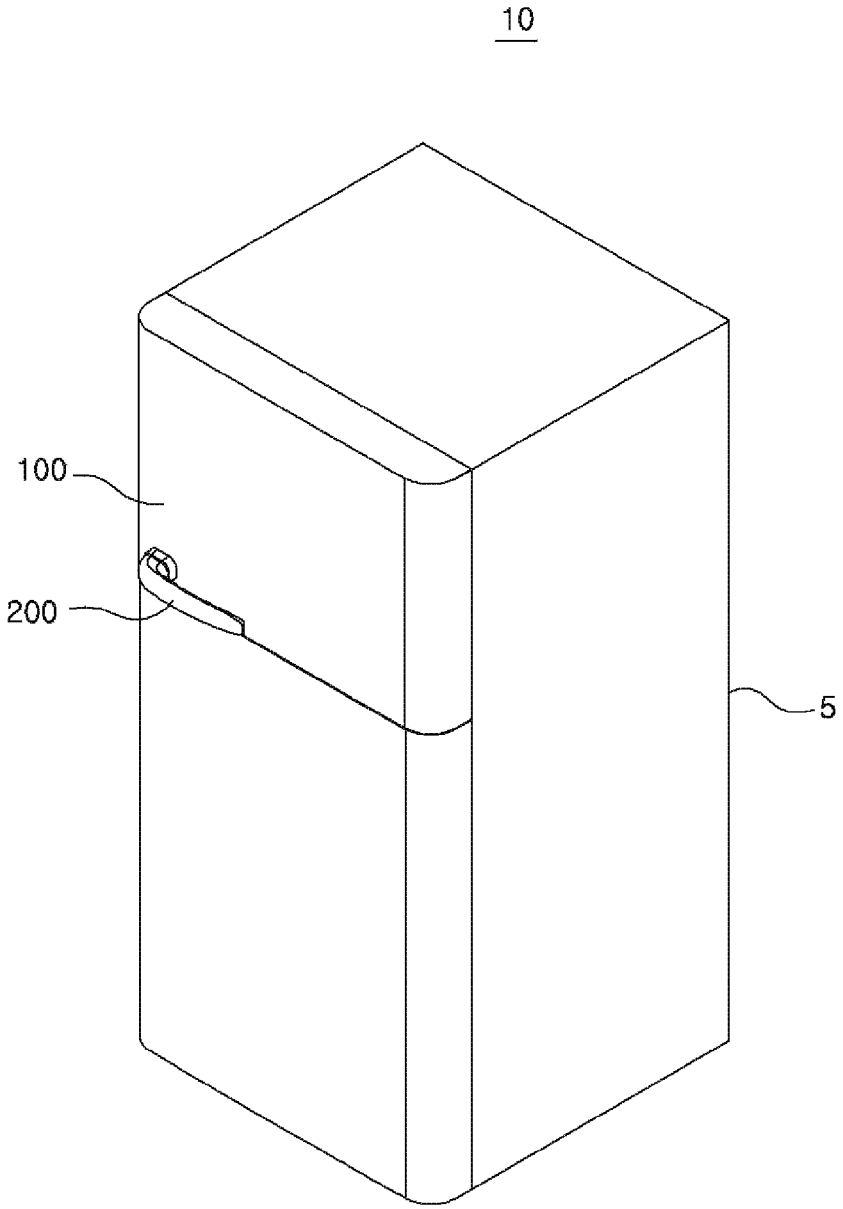
FIG. 1 is a perspective view illustrating the configuration of an exemplary refrigerator according to one embodiment of the present disclosure.

In the following detailed description, reference is made to the accompanying drawings, which form a part hereof. The illustrative embodiments described in the detailed description, drawings, and claims are not meant to be limiting. Other embodiments may be utilized, and other changes may be made, without departing from the spirit or scope of the subject matter presented here.

One or more exemplary embodiments of the present disclosure will be described more fully hereinafter with reference to the accompanying drawings, in which one or more exemplary embodiments of the disclosure can be easily determined by those skilled in the art. As those skilled in the art will realize, the described exemplary embodiments may be modified in various different ways, all without departing from the spirit or scope of the present disclosure, which is not limited to the exemplary embodiments described herein.

It is noted that the drawings are schematic and are not necessarily dimensionally illustrated. Relative sizes and proportions of parts in the drawings may be exaggerated or reduced in size, and a predetermined size is just exemplary and not limiting. The same reference numerals designate the same structures, elements, or parts illustrated in two or more drawings in order to exhibit similar characteristics.

The exemplary drawings of the present disclosure illustrate ideal exemplary embodiments of the present disclosure in more detail. As a result, various modifications of the drawings are expected. Accordingly, the exemplary embodiments are not limited to a specific form of the illustrated region, and for example, may include modifications for manufacturing.

Preferred embodiments of the present disclosure are described in detail with reference to the accompanying drawings.

Figure 2:
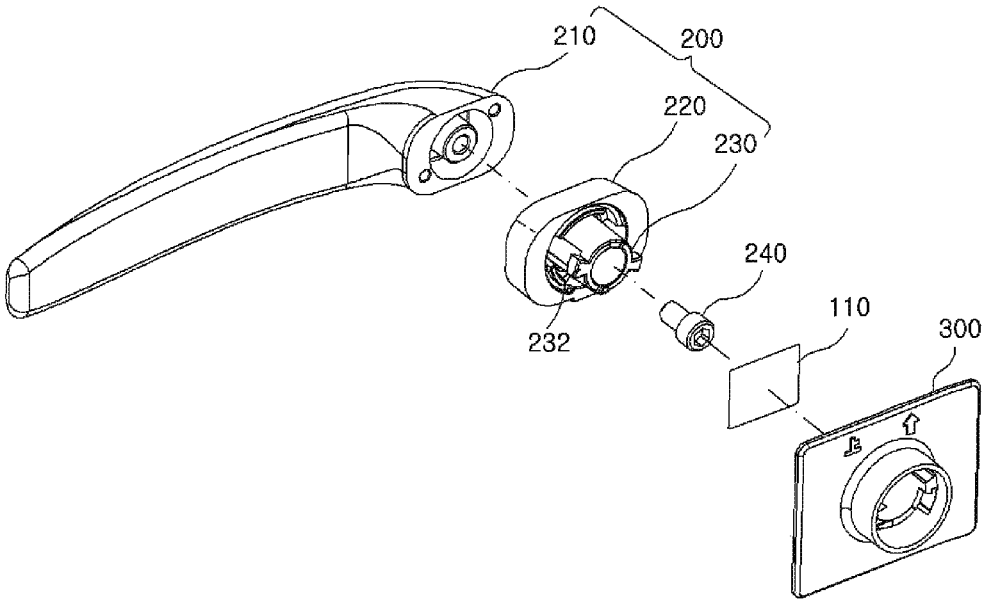
FIG. 2 is an exploded perspective view of the exemplary refrigerator illustrated in FIG. 1.
Figure 3:
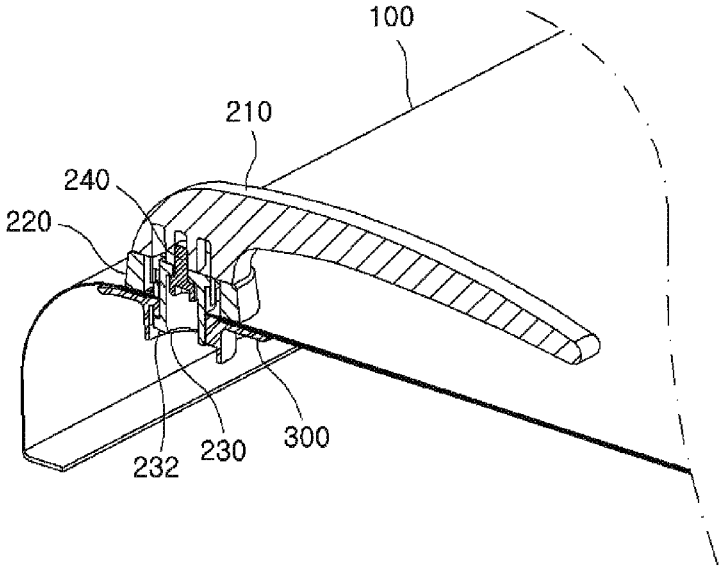
FIG. 3 is a side sectional view of the exemplary refrigerator illustrated in FIG. 1.
Figure 4:
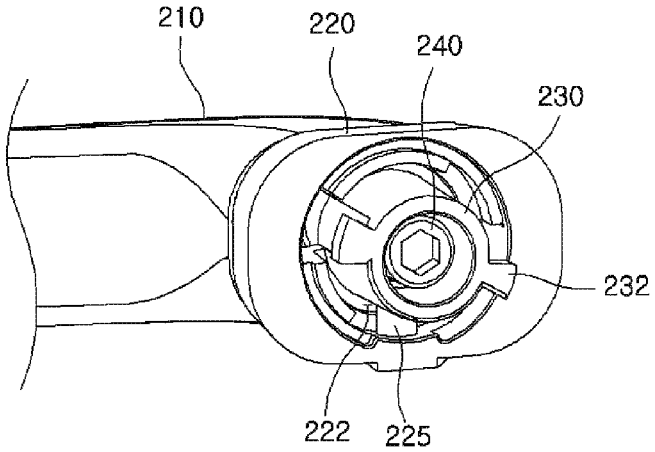
FIG. 4 is a bottom perspective view illustrating the configuration of an exemplary door handle on the refrigerator illustrated in FIG. 1.
Figure 5:
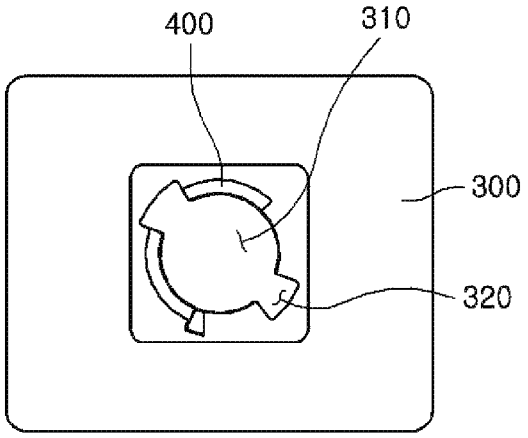
FIG. 5 is a front plane view of an exemplary intermediary member of the refrigerator illustrated in FIG. 1.
Figure 6:
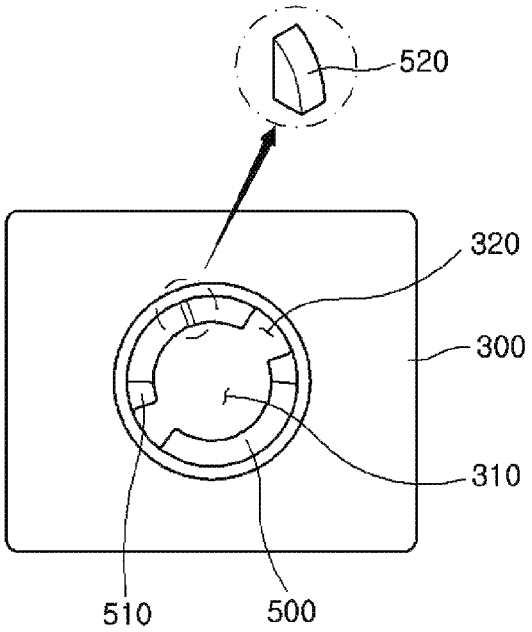
FIG. 6 is a rear plane view of the exemplary intermediary member of the refrigerator illustrated in FIG. 1.

FIG. 1 is a perspective view illustrating the configuration of an exemplary refrigerator according to one embodiment of the present disclosure. FIG. 2 is an exploded perspective view of the exemplary refrigerator illustrated in FIG. 1. FIG. 3 is a side sectional view of the exemplary refrigerator illustrated in FIG. 1. FIG. 4 is a bottom perspective view illustrating the configuration of an exemplary door handle on the refrigerator illustrated in FIG. 1. FIG. 5 is a front plane view of an exemplary intermediary member of the refrigerator illustrated in FIG. 1. FIG. 6 is a rear plane view of the exemplary intermediary member of the refrigerator illustrated in FIG. 1.

Referring to FIGS. 1 to 6, the refrigerator 10 according to one embodiment of the present disclosure may include a door 100 having a through-hole 110, a door handle 200 rotatably coupled to the door 100, an intermediary-member 300 disposed on the front surface of the door 100 and coupled to the door handle 200, a front protrusion portion 400 inserted into the through-hole 50 and protruding from the front surface of the intermediary member 300 toward the front side of the door 100, and a rear protrusion portion 500 surrounding the insertion portion 230 and protruding from the rear surface of the intermediary member 300 toward the rear side (facing the interior of the refrigerator when the door is closed) of the door 100.

The door 100 covers a storage space-in the main body. The door 100 may be a refrigeration compartment door or a freezer door. The door 100 may be hingedly and rotatably coupled to the main body 5.

The door 100 may have a through-hole 110 into which the door handle 200 is inserted. The intermediary member 300 may be inserted into the through-hole 110 and fixed to the door 100.

The door handle 200 can rotate in relation to the door 100. The door handle 200 may include a grip portion 210 for holding by a user, a connection portion 220 fastened to the grip portion 210 and having an undercut portion 222 for accommodating the front protrusion portion 400, and an insertion portion 230 protruding from the connection portion 220.

For example, the grip portion 210 may have an elongated rod shape and can be easily gripped by a user.

The connection portion 220 may be fastened to the grip portion 210. The undercut portion 222 may be formed in the connection portion 220 and accommodate the front protrusion portion 400.

The connection portion 220 may have a contact member 225 protruding from the inner circumferential surface of the undercut portion 222. When the door handle 200 is rotated, the contact member 225 may selectively make contact with the front protrusion portion 400 and may restrict the rotation of the door handle 200.

For example, the insertion portion 230 may protrude from the connection portion 220. The insertion portion 230 may be fixed to the connection portion 220 via a fastening member 240. For example, the fastening member 240 may face toward the insertion portion 230.

An engaging projection 232 may protrude outward from the peripheral surface of the insertion portion 230. During assembly of the door handle 200 with the door 100, the engaging projection 232 may selectively engage with a first stopper 510 to restrict rotation of the door handle 200. In an assembled state, the engaging projection 232 may selectively engage with a second stopper 520 to restrict rotation of the door handle 200.

The intermediary member 300 may be disposed on the front surface of the door 100 and may be coupled to the door handle 200. The intermediary member 300 may have an insertion hole 310 and an engaging projection insertion groove 320. The insertion portion 230 and the engaging projection 232 of the door handle 200 can be inserted into the insertion hole 310 and the engaging projection insertion groove 320.

The front protrusion portion 400 may be inserted into the through-hole 110 of the door 100 and may protrude from the front surface of the intermediary member 300 toward the front side of the door 100. Furthermore, the front protrusion portion 400 may be accommodated within, and coupled to, the undercut portion 222 formed in the connection portion 220 of the door handle 200. The distal end of the front protrusion portion 400 may come into contact with the contact member 225 during rotation of the door handle 200.

The rear protrusion portion 500 may surround the insertion portion 230 of the door handle 200 and may protrude from the rear surface of the intermediary member 300 toward the rear side of the door 100.

The rear protrusion portion 500 may include a first stopper 510 used to limit the rotation range of the door handle when the engaging projection 232 rotates within the rear protrusion portion 500.

The door handle 200 can be assembled with the door 100 by rotating the door handle 200 in a certain direction (or the first direction). To open and close the door 100, the door handle 200 needs to be rotated in an opposite direction (or the second direction). However, when a user rotates the door handle 200 in the second direction, the first stopper cannot stop the engaging projection 232 from being aligned with or from being inserted into the engaging projection insertion groove 320, which would undesirably cause the door handle 200 to decouple from the door 100.

To prevent this problem, a second stopper 520 is formed on the route through which the engaging projection 232 rotates along the inner circumferential surface of the rear protrusion portion 500.

The second stopper 520 is configured to limit the rotation of the door handle 200 in the second direction. The second stopper 520 may be made of, for example, an elastic material and may be inclined upward. The second stopper 520 allows the engaging projection 232 to pass through it without being stopped when the engaging projection 232 rotates in the first direction. Whereas, the second stopper 520 acts to stop the rotation of the engaging projection 232 when it rotates in the second direction.

Hereinafter, an exemplary assembly process of the door handle 200 and its usage is described with reference to FIGS. 7 to 12.

Figure 7:
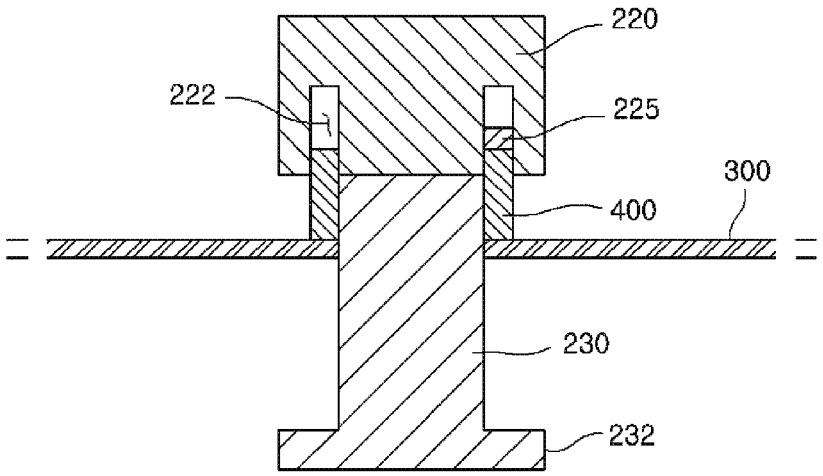
FIG. 7 is a side sectional view illustrating a state in which an engaging projection of the door handle is inserted into an engaging projection insertion groove of the intermediary member.
Figure 8:
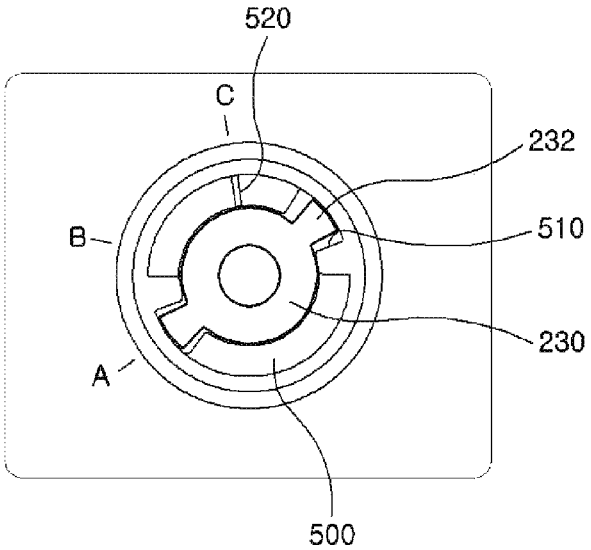
FIG. 8 is a bottom view of the exemplary door handle and the exemplary intermediary member illustrated in FIG. 7.
Figure 9:
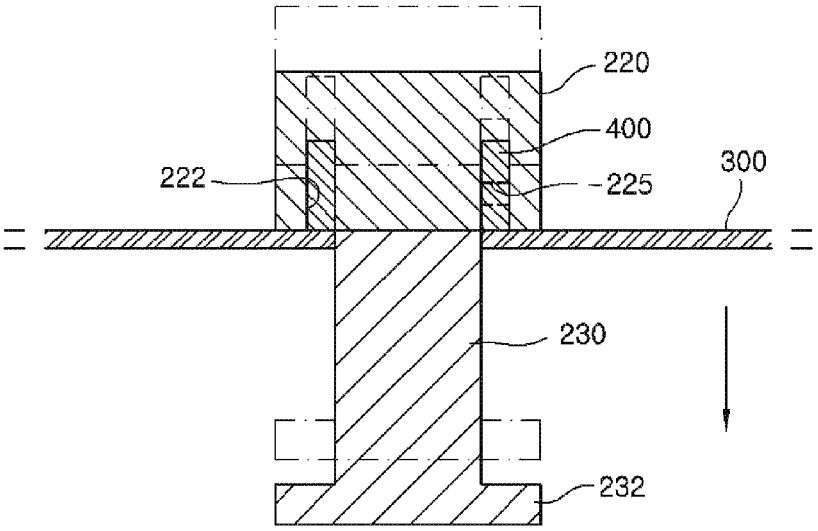
FIG. 9 is a side sectional view illustrating a state in which the engaging projection of the door handle engages with a second stopper in the course of rotating the door handle in a first direction.
Figure 10:
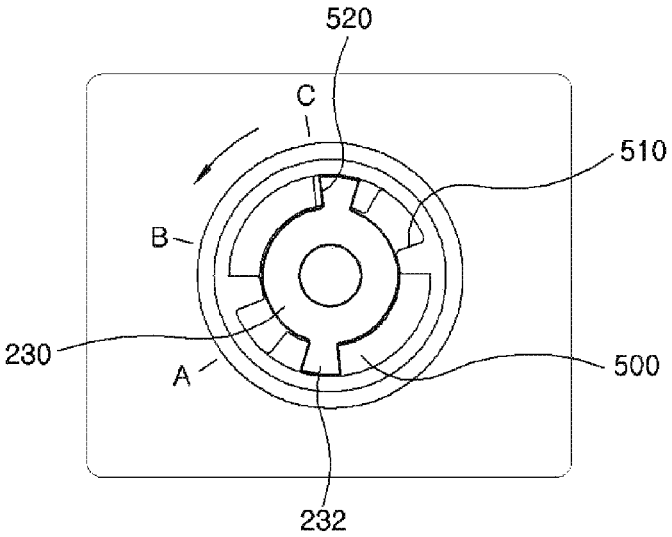
FIG. 10 is a bottom view of the exemplary door handle and the exemplary intermediary member illustrated in FIG. 9.
Figure 11:
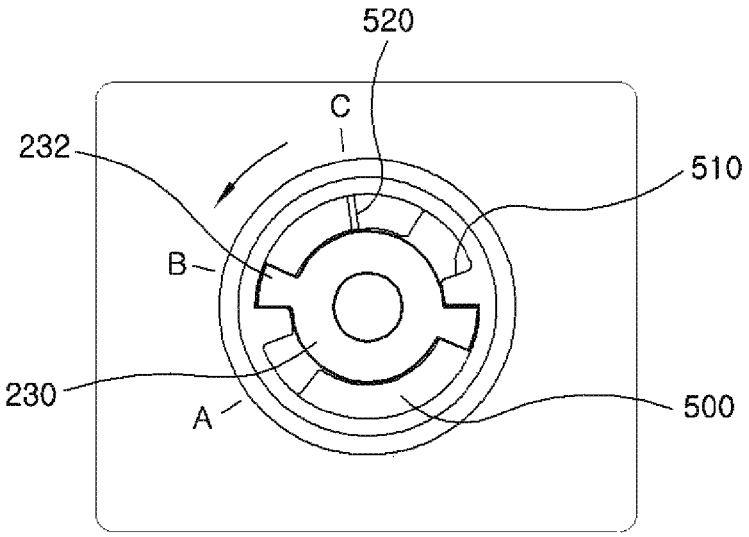
FIG. 11 is a bottom view illustrating a state in which the exemplary door handle is assembled.
Figure 12:
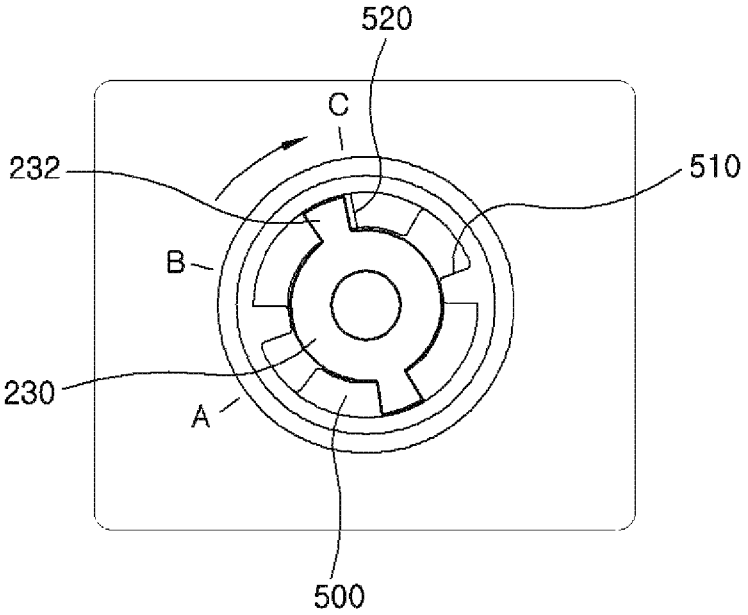
FIG. 12 is a bottom view illustrating a state in which the engaging projection of the door handle engages with the second stopper in the course of rotating the door handle in a second direction.

FIG. 7 is a side sectional view illustrating a state in which an engaging projection of the door handle is inserted into an engaging projection insertion groove of the intermediary member. FIG. 8 is a bottom view of the exemplary door handle and the exemplary intermediary member illustrated in FIG. 7. FIG. 9 is a side sectional view illustrating a state in which the engaging projection of the door handle engages with a second stopper in the course of rotating the door handle in a first direction. FIG. 10 is a bottom view of the exemplary door handle and the exemplary intermediary member illustrated in FIG. 9. FIG. 11 is a bottom view illustrating a state in which the exemplary door handle is assembled. FIG. 12 is a bottom view illustrating a state in which the engaging projection of the door handle engages with the second stopper in the course of rotating the door handle in a second direction.

The point at which the engaging projection 232 is inserted into the engaging projection insertion groove 320 is referred to as a point A. The point at which the engaging projection 232 engages with the first stopper 510 during rotation in the first direction is referred as a point B. The point at which the engaging projection 232 engages with the second stopper 520 during rotation in the second direction opposite to one direction is referred as a point C.

The points A, B and C are designated with reference to the rear surface of the intermediary member 300. FIGS. 8, 10, 11 and 12 show the rear surface of the intermediary member 300.

First, the engaging projection 232 of the insertion portion 230 of the door handle 200 is inserted into the engaging projection insertion groove 320 of the intermediary member 300.

The contact member 225 makes contact with the upper side of the front protrusion portion 400 at the initial stage of the door handle assembly process. Thus, at least a portion of the connection portion 220 contacts the front protrusion portion 400, whereby the connection portion 220 and the front surface of the intermediary member 300 may be spaced apart from each other by a predetermined distance.

To fix the door handle 200 to the door 100, the front protrusion portion 400 needs be completely accommodated within and coupled to the undercut portion 222. To achieve this state, the door handle 200 needs to be rotated in the first direction. For example, the "one direction" or "first direction" used herein may be a counterclockwise direction as shown in FIG. 10. Thus, the engaging projection 232 may be rotated counterclockwise and may be moved from point A to point B.

As a user holds the grip portion 210 of the door handle 200 and rotates the door handle 200 counterclockwise, the engaging projection 232 moves from point A to point B. As a result, the door handle 200 can be assembled with the door 100.

Thus, the contact member 225 making contact with the upper side of the front protrusion portion 400 is rotated clockwise at the upper side of the front protrusion portion 400 and moves down toward the front surface of the intermediary member 300 when the contact member 225 reaches a peripheral surface region of the through-hole 110 where the front protrusion portion 400 is absent. Consequently, the connection portion 220 firmly contacts the front surface of the intermediary member 300. Since the front protrusion portion 400 protruding from the front surface of the intermediary member 300 can be accommodated within and coupled to the undercut portion 222, the door handle assembly process may be performed when the coupling between the door handle 200 and the door 100 is maintained stable.

At this time, the contact member 225 has moved down on the front surface of the intermediary member 300 and the engaging projection 232 engages with the second stopper 520 on the rear surface of the intermediary member 300. If the engaging projection 232 is further rotated in this state, the engaging projection 232 passes through the second stopper 520.

More specifically, in assembling the door handle 200 with the door 100, the engaging projection 232 passes through point C before reaching point B in the course of moving from point A to point B. Thus, the engaging projection 232 first meets with the second stopper 520. The second stopper 520 is made of an elastic material (e.g., having predetermined elasticity) and has a structure inclined upward in the counterclockwise direction which is the rotation direction of the engaging projection 232 in FIG. 10. Thus, the second stopper 520 does not stop the engaging projection 232 when it rotates counterclockwise.

After passing the second stopper 520, the engaging projection 232 can continue to be rotated along the inner circumferential surface of the rear protrusion portion 500 until being stopped by the first stopper 510.

As it is rotated in the second direction, the engaging projection 232 can be stopped by the inclined structure of the second stopper 520. The second direction may be a clockwise direction on the basis of FIG. 12. Thus, the engaging projection 232 can rotate clockwise and can move from point B to point C.

In other words, the door 100 can be opened and closed while the engaging projection 232 is rotated in a range defined by the first stopper 510 and the second stopper 520 (between point B and point C).

The second stopper 520 is positioned more forward than the engaging projection insertion groove 320 on the route through which the engaging projection 232 of the door handle 200 is rotated from point B toward point C along the inner circumferential surface of the rear protrusion portion 500. Thus even if the engaging projection 232 is rotated in the second direction, the engaging projection 232 cannot be inserted into the engaging projection insertion groove 320.

Accordingly, after assembled with the door handle, when the door handle 200 is rotated clockwise as shown in FIG. 12 (e.g., to open or close the door), the engaging projection 232 would not be inserted into the engaging projection insertion groove 320 because the engaging projection 232 can engage with the second stopper 520. Thus, the door handle 200 would not be separated from the door 100 when a user opens or closes the door. Using the door handle, a user can advantageously open and close the door 100 with reduced effort and without the risk of straining the wrist.

From the foregoing, it will be appreciated that various embodiments of the present disclosure have been described herein for purposes of illustration, and that various modifications may be made without departing from the scope and spirit of the present disclosure. The exemplary embodiments disclosed in the specification of the present disclosure are not intended to limit the present disclosure. The scope of the present disclosure will be interpreted by the claims below, and it will be construed that all techniques within the scope equivalent thereto belong to the scope of the present disclosure.

What is claimed is:

1. A refrigerator comprising:

a door comprising a through-hole;

a door handle coupled to the door and operable to be rotated in relation to the door;

an intermediary member disposed on a front surface of the door and coupled to the door handle; and a front protrusion portion inserted into the through-hole and protruding from a front surface of the intermediary member, wherein the door handle comprises:

a grip portion;

a connection portion fastened to the grip portion and comprising an undercut portion for accommodating the front protrusion portion; and an insertion portion protruding from the connection portion, wherein the insertion portion comprises an engaging projection protruding outward from a peripheral surface of the insertion portion, and wherein the refrigerator further comprises:

a rear protrusion portion surrounding the insertion portion and protruding from a rear surface of the intermediary member toward a rear side of the door;

a first stopper protruding from a portion of the rear protrusion portion and configured to stop rotation of the engaging projection as the engaging projection is rotated in a first direction;

a second stopper configured to stop rotation of the door handle as the door handle is rotated in a second direction, the second stopper being located along a route through which the engaging projection rotates along the inner circumferential surface of the rear protrusion portion; and a contact member protruding from an inner circumferential surface of the undercut portion of the connection portion and configured to contact the front protrusion portion.

2. The refrigerator of claim 1, wherein the engaging projection is configured to rotate along an inner circumferential surface of the rear protrusion portion.

3. The refrigerator of claim 1, wherein during an assembly process of the door handle with the door, the door handle is operable to be rotated in the first direction until the engaging projection engages with the first stopper.

4. The refrigerator of claim 1, wherein, when the door handle is rotated in the second direction by a user for opening or closing the door, the contact member is operable to be rotated within a rotation region defined by the front protrusion portion.

5. A refrigerator comprising:

a door comprising a through-hole;

a door handle coupled to the door and operable to rotate in relation to the door, wherein the door handle comprises a first stopper and a second stopper, wherein the first stopper is configured to stop rotation of the door handle when the door handle is rotated in a first direction during a process of assembling the door handle with the door, and wherein further the second stopper is configured to stop rotation of the door handle only when the door handle is rotated in a second direction, and wherein further the door is opened or closed when the door handle is rotated in the second direction;

an intermediary member disposed on a front surface of the door and coupled to the door handle; and a front protrusion portion inserted into the through-hole and protruding from a front surface of the intermediary member, wherein the door handle further comprises:

a grip portion;

a connection portion coupled to the grip portion and comprising an undercut portion for accommodating the front protrusion portion; and an insertion portion protruding from the connection portion, wherein the insertion portion comprises an engaging projection protruding outward from a peripheral surface of the insertion portion, and wherein the refrigerator further comprises a contact member protruding from an inner circumferential surface of the undercut portion of the connection portion and configured to selectively contact the front protrusion portion.

6. The refrigerator of claim 5, further comprising:

a rear protrusion portion formed at a radial outer side of the insertion portion and protruding from a rear surface of the intermediary member toward a rear side of the door.

7. The refrigerator of claim 6, wherein the first stopper protrudes from a portion of the rear protrusion portion and configured to stop the engaging projection as the engaging projection is rotated in the first direction.

8. The refrigerator of claim 7, wherein the engaging projection is configured to be rotated along an inner circumferential surface of the rear protrusion portion.

9. The refrigerator of claim 8, wherein the second stopper is located along a route through which the engaging projection is rotated along the inner circumferential surface of the rear protrusion portion.

10. The refrigerator of claim 5, wherein the first stopper is operable to stop rotation of the door handle when the engaging projection engages with the first stopper.

11. The refrigerator of claim 5, wherein, when the door handle is rotated by a user for opening or closing the door, the contact member is operable to be rotated within a rotation region defined by the front protrusion portion.

* * * * *